US012507755B2

(12) United States Patent
Borgogna

(10) Patent No.: US 12,507,755 B2
(45) Date of Patent: Dec. 30, 2025

(54) FOOTWEAR AND FOOTWEAR PRODUCTION PROCESS

(71) Applicant: Cintia Arcas Saturnino Borgogna, Mission Viejo, CA (US)

(72) Inventor: Cintia Arcas Saturnino Borgogna, Mission Viejo, CA (US)

( * ) Notice: Subject to any disclaimer, the term of this patent is extended or adjusted under 35 U.S.C. 154(b) by 128 days.

(21) Appl. No.: 18/041,338

(22) PCT Filed: Aug. 13, 2020

(86) PCT No.: PCT/IB2020/057611
§ 371 (c)(1),
(2) Date: Feb. 10, 2023

(87) PCT Pub. No.: WO2022/034363
PCT Pub. Date: Feb. 17, 2022

(65) Prior Publication Data

US 2023/0284727 A1 Sep. 14, 2023

(51) Int. Cl.

| | |
|---|---|
| ***A43B 1/00*** | (2006.01) |
| ***A43B 1/025*** | (2022.01) |
| ***A43B 1/14*** | (2006.01) |
| ***A43B 13/04*** | (2006.01) |
| ***A43B 23/02*** | (2006.01) |
| ***A43D 25/047*** | (2006.01) |

(52) U.S. Cl.
CPC ..... *A43B 1/0063* (2013.01); *A43B 1/025* (2022.01); *A43B 1/14* (2013.01); *A43B 13/04* (2013.01); *A43B 23/0215* (2013.01); *A43D 25/047* (2013.01)

(58) Field of Classification Search
CPC ..... A43B 1/0063; A43B 1/025; A43B 13/125; A43B 13/127
See application file for complete search history.

(56) References Cited

U.S. PATENT DOCUMENTS

| | | | | |
|---|---|---|---|---|
| 5,671,495 A * | 9/1997 | Chen | A43B 13/127 19/145.5 |
| 8,578,535 B2 * | 11/2013 | Dojan | B29D 35/146 12/142 R |
| 2002/0040538 A1 * | 4/2002 | Kim | A43B 1/025 36/3 R |
| 2004/0115380 A1 * | 6/2004 | Hsueh | A43B 1/14 428/35.7 |

(Continued)

FOREIGN PATENT DOCUMENTS

| | | | |
|---|---|---|---|
| ES | 1076224 U * | 2/2012 | A43B 1/0081 |
| WO | WO-2015058268 A1 * | 4/2015 | A43B 1/02 |

*Primary Examiner* — Jameson D Collier
(74) *Attorney, Agent, or Firm* — Ohlandt, Greeley and Perle, LLP.

(57) ABSTRACT

Footwear and footwear production process includes steps that include the reuse of raw materials previously used in footwear or other sources. The process also provides for the reduction of waste and environmental impact as well as the elimination of water consumption. Footwear includes renewable origin, natural, recycled and recyclable components, being a sustainable product, ecologically viable and inserted in the context of Circular Bio Economy. The footwear presents quality standards in accordance with standard technical standards of quality, overcoming challenges related to obtaining comfortable and simultaneously sustainable shoes.

4 Claims, 3 Drawing Sheets

(56) References Cited

U.S. PATENT DOCUMENTS

| | | | | |
|---|---|---|---|---|
| 2010/0263240 | A1* | 10/2010 | Shelton | A43B 1/0063<br>12/146 BR |
| 2013/0160223 | A1* | 6/2013 | Bier | A43B 23/022<br>12/146 B |
| 2014/0310986 | A1* | 10/2014 | Tamm | A43B 23/0245<br>12/142 T |

* cited by examiner

FOOTWEAR AND FOOTWEAR PRODUCTION PROCESS

This invention relates to a footwear and its production process thereof. More specifically, this invention deals with a footwear production process composed of renewable and sustainable elements and constituents, some of recycled origin and others natural, among other materials, said process promoting the reuse of raw materials, some with biodegradable characteristics, reducing waste and environmental impacts and eliminating water consumption.

In addition, another purpose of the present invention refers to footwear itself, resulting from said manufacturing process, which, in addition to consisting of renewable and sustainable elements and constituents, promotes unique comfort, due to the materials used.

BACKGROUND OF THE INVENTION

Considering the scarcity of natural resources indispensable to human life, the development of sustainable, ecologically viable technologies, products and services becomes increasingly important. Thus, life is maintained and resources are reused over time.

In this context, there are many efforts to develop technologies capable of providing a sustainable life model, such as shoes made of materials of renewable origin and their production processes. However, even though they are important from an ecological point of view, such technologies present problems ranging from processes with high water consumption to those that do not use materials that are actually renewable from the start. In addition, the use of only virgin raw materials is another aspect that constitutes a technical problem of these processes and products, as they neglect the use of recyclable materials regardless of their origin (plastic bottles, rubbers in general, cotton-based fabrics, components from discarded shoes, etc.) for the purpose of reducing waste.

Regarding footwear, even though they receive the designation of sustainable shoes or equivalent names, these shoes do not have raw materials of renewable or recycled origin, contributing to the waste of resources that could be alternatively reused for other purposes. Additionally, these shoes have leather in their constitution, which is a material that takes a long time to complete degrade in the environment. In other words, contrary to the logic of sustainability.

In order to better understand the technical problems involved, the closest state-of-the-art technologies in the field of the present invention will be described below, especially shoes made of renewable or recycled materials.

In this context, document CN104172653 discloses a sole comprising an outer layer of rubber, an intermediate layer based on coconut shell fibers and a layer based on cotton fabric over the coconut layer. Also described is a shoe comprising said sole and an upper of cotton fabric. Additionally, a sole production method is described including opening and carding of coconut fiber, cutting and forming, conducting adhesive spray treatment, high temperature forming, hot pressing treatment, solidification and forming, modeling, refining in a manner mixed, modeling, hot pressing and sole formation. The footwear described in this document comprises leather, being considered a material with slow environmental degradation, remaining in the environment for hundreds of years. In addition, the use of recycled raw materials is not described and the production process is directed towards obtaining a shoe sole, and a production process for the footwear itself is not described.

Document WO2011055510, in turn, describes a shoe comprising an upper with a lower portion, a sole and an insole. In one of the types of technology described, the upper is made of coconut or fabric, the sole is made of rubber or cork and the insole consists of fabric. In addition to not mentioning the reuse of raw materials, said footwear uses synthetic resins and leather, materials with a high negative environmental impact. The combination of insoles revealed in this state-of-the-art document does not present comfort to a user. Finally, said document does not present a solution for a sustainable footwear manufacturing process either.

Document DE10319480 discloses a shoe comprising an insole based on overlapping layers. The layers are described as being based on a type of raw material chosen from a plurality of types, including coconut fibers, fabric, cork, leather, plastics or rubber. Additionally, the combination of these types of fibers in the same insole is also described. In addition to presenting leather as constituent materials, said footwear does not contain recycled materials, being a product that is harmful to the environment. Additionally, this technology does not provide a sustainable footwear production process either.

Document US2002040538 teaches an insole comprising a layer of coconut fibers, an adhesive layer of natural latex and a layer based on fibers of natural fabric. A production process for this insole is described, as well as its application in shoes. Despite describing a material that encompasses natural materials such as coconut fibers and natural fabric fibers, this state-of-the-art technology does not reuse raw materials and does not offer solutions for the design of sustainable footwear comprising recycled products. In addition, the described process is aimed at obtaining insoles, and a sustainable footwear production process is not described as proposed in this invention.

Document KR2013131850 describes an insole comprising a layer of leather, a layer of cork, two layers of latex and a support layer. The technology described in this state-of-the-art document uses leather which, as already mentioned, is a product that is harmful to the environment. Also for this case, a sustainable footwear, as proposed in the present invention, and a process for obtaining said footwear are not described.

Document EP815758 also presents a shoe comprising an insole, said insole comprising a layer of natural latex adhered to a layer of cork. However, no solutions are described for the design of sustainable footwear and its production process, as proposed in the present invention.

Considering the above, the state-of-the-art would clearly benefit from a footwear production process that reuses raw materials of renewable origin, in addition to reusing footwear components in general and other sources as well as recycled materials, which can allow the reduction of waste due to the reuse of components that would be discarded in the environment, and that, finally, eliminates the consumption of water in its manufacture. The design of footwear is also a solution of the present invention to the problems of the state-of-the-art, mainly because it is a product free from components harmful to the environment, such as resins and leather, and because it uses natural, recycled and recyclable components from renewable sources.

BRIEF DESCRIPTION OF THE INVENTION

In a first aspect, the present invention refers to a footwear production process comprising unique manufacturing steps, due to the origin of the materials selected for the manufacture of the footwear, most of which are of renewable origin, and whose process promotes the reduction of waste of raw materials, in addition to not using water at any stage of the process, which results in unique and long-lasting comfort shoes.

In a second aspect, the present invention relates to a footwear comprising components of renewable origin, some recycled and recyclable, as well as natural, whose final constitution makes it possible to insert it in the Circular Bio Economy, by reducing environmental impacts in its manufacture, use and disposal.

BRIEF DESCRIPTION OF THE DRAWINGS

The subject matter of this Invention will be totally clear in its technical aspects from the detailed description that will be made based on the figures listed below, in which.

DETAILED DESCRIPTION OF THE INVENTION

Figure 1:
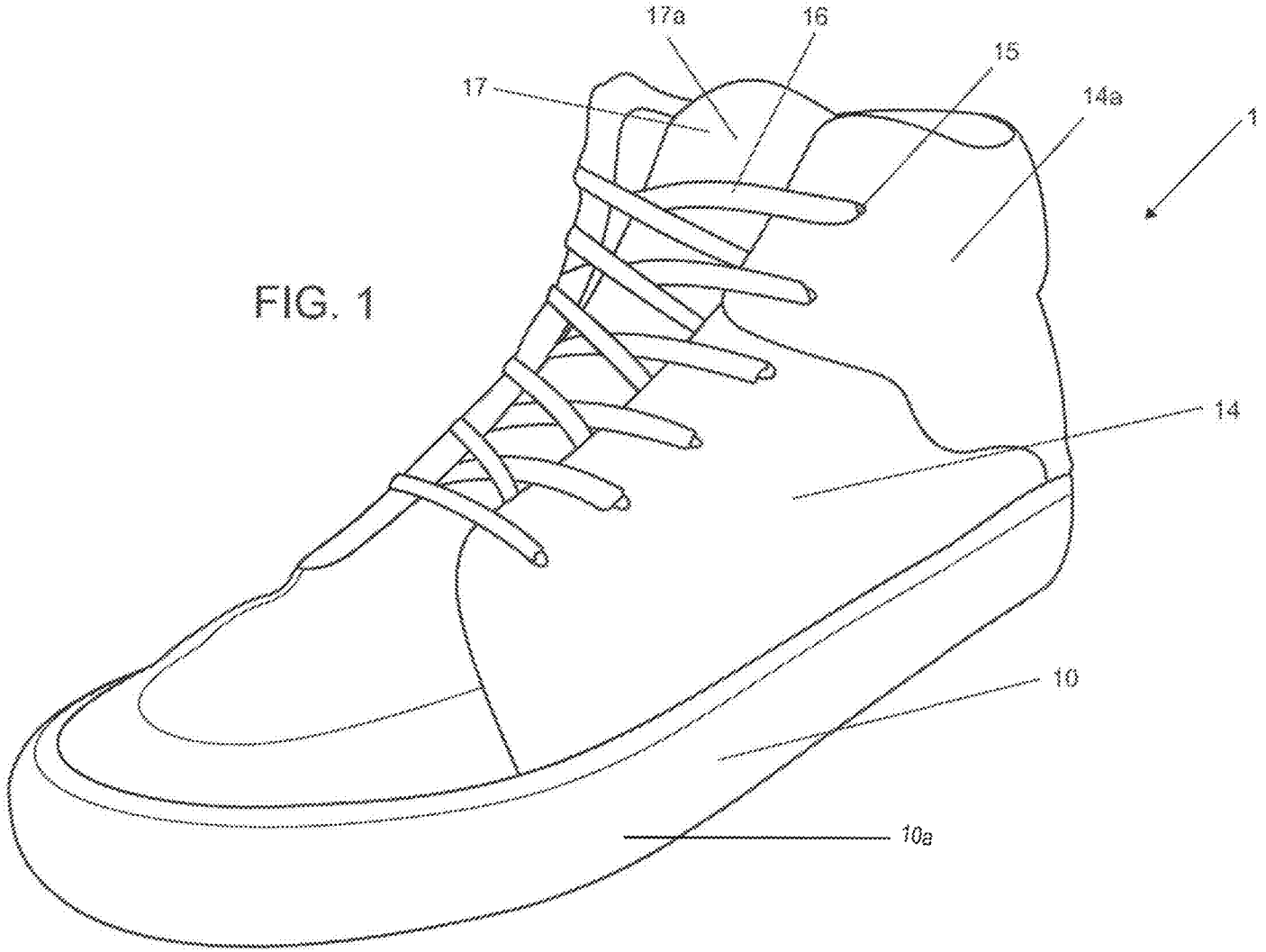
FIG. 1 shows the footwear.
Figure 2:
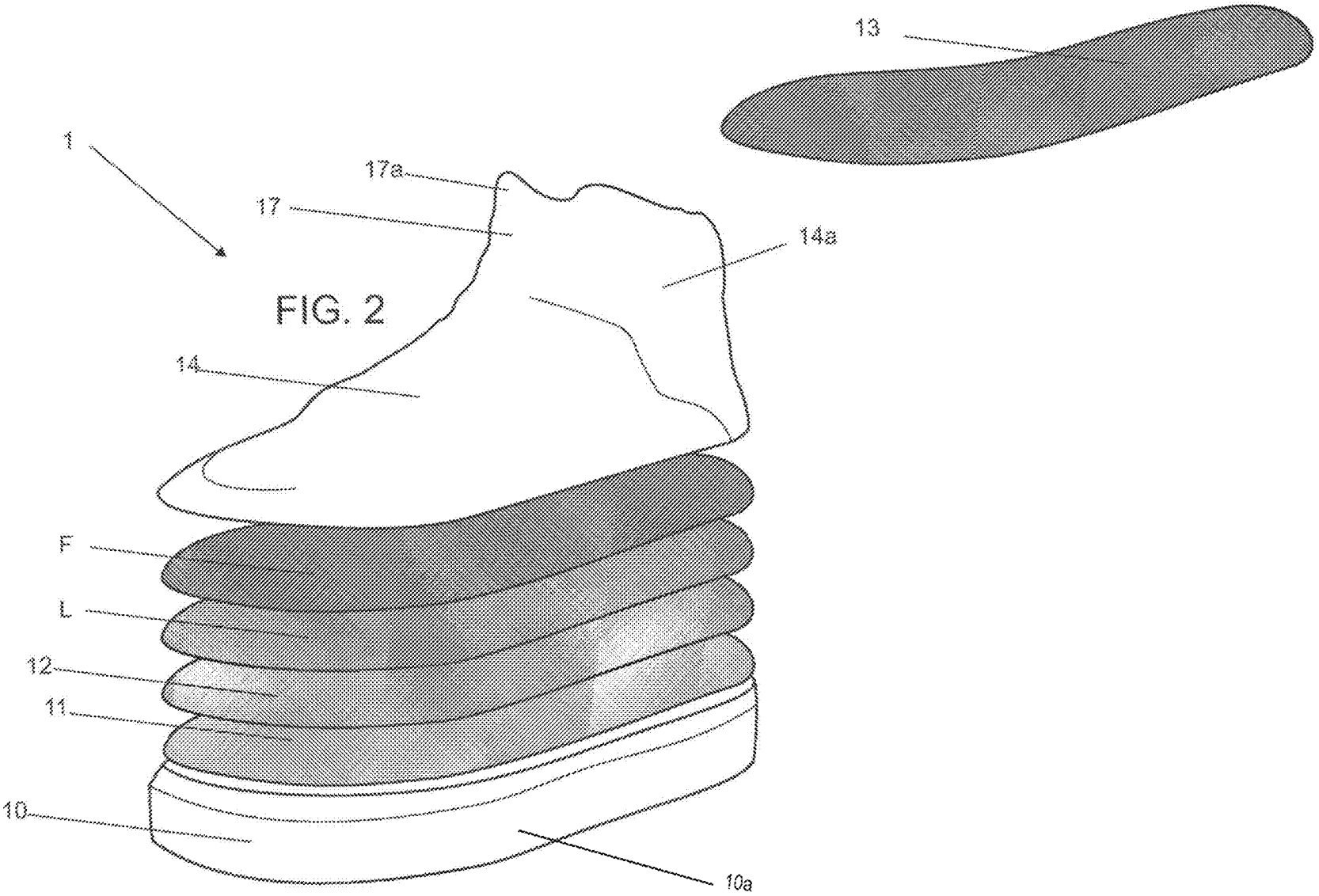
FIG. 2 shows the footwear and its components.
Figure 3:
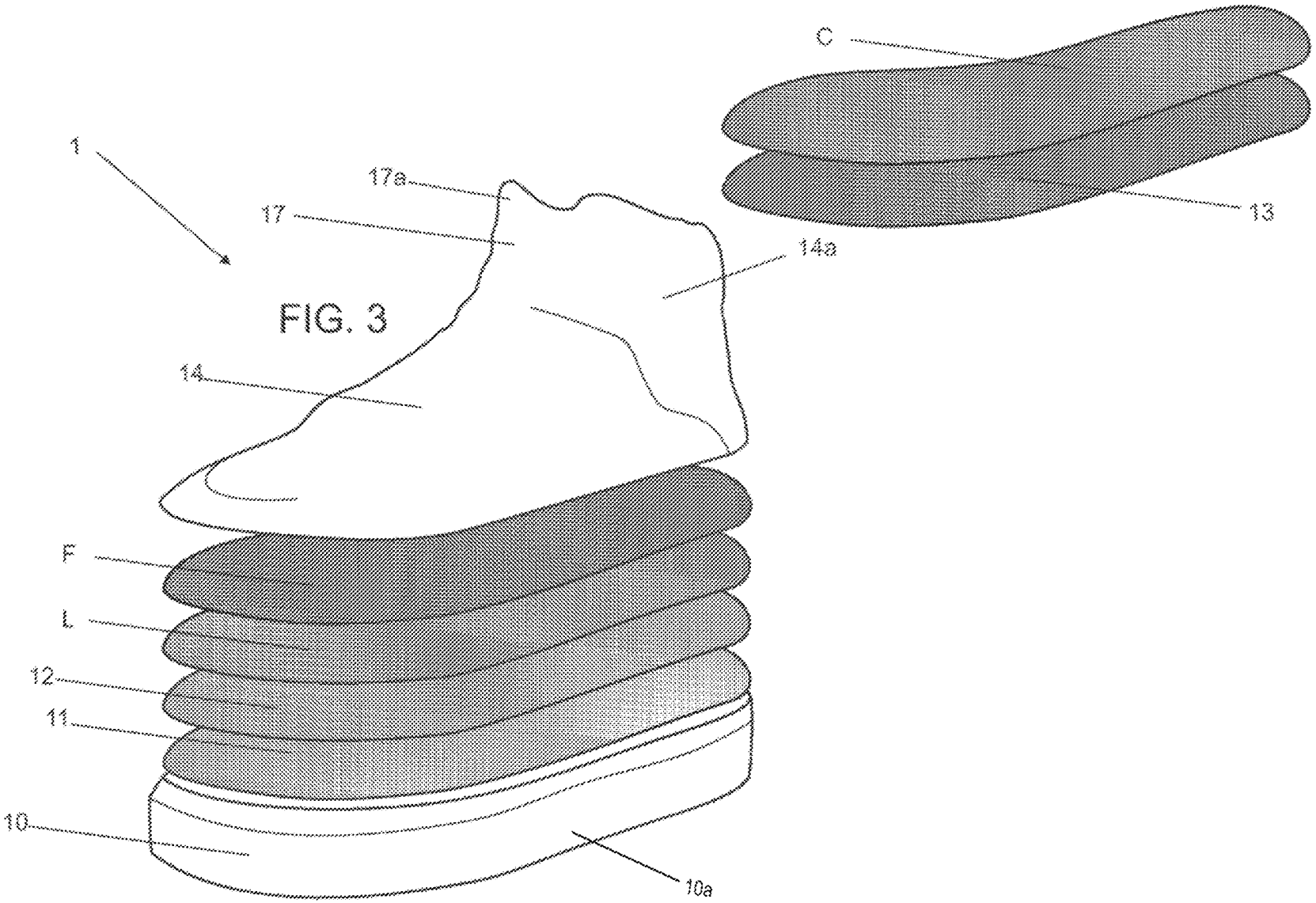
FIG. 3 shows the footwear and its components, additionally comprising an aesthetic layer.

In a first aspect, the present invention refers to a FOOTWEAR (1) PRODUCTION PROCESS comprising the following steps:

(a) cutting a first fabric, obtaining an inner lining and an insole lining (F); and cutting a first recycled fabric, obtaining an upper, said upper comprising metal-free eyelets;

(b) stitching the inner lining on the inner surfaces of the upper;

(c) positioning the insole lining (F) on a white latex midsole (L), and positioning the white latex midsole (L) on a recycled midsole;

(d) simultaneous sewing of the insole lining (F), white latex midsole (L) and recycled midsole at the base of the upper, obtaining a upper with a base, said base comprising an externally exposed recycled midsole surface;

(e) bonding a midsole of natural material on the exposed surface of the recycled midsole; obtaining an insole upper, said insole comprising the insole lining (F), white latex midsole (L), recycled midsole and natural material midsole, in that order; said insole comprising the surface of the midsole of natural material exposed externally;

(f) positioning the upper with an insole in a format-regulating device;

(g) adding glue to the side walls of a recycled sole;

(h) bonding the side walls of the recycled sole to the lower sides of the upper with an insole;

(i) side seam of the recycled sole in the upper with insole, obtaining semi-finished footwear;

(j) drying the semi-finished footwear in times between 1 and 8 min, under temperatures between 2° and 60° C., and cooling the semi-finished footwear to room temperature; and (k) adding a removable insole inside the semi-finished footwear and adding laces to the metal-free eyelets present in the upper half of the semi-finished footwear; and obtaining the footwear (1).

For the purposes of the present invention, room temperature is understood to be the temperature between 18 and 25° C.

In step (a) of the process now described, the first fabric comprises a thin cotton fabric, said cotton being recycled organic cotton, without, however, being limited to said thin cotton fabric. The first recycled fabric, in turn, comprises a mixture of recycled cotton fabric and recycled plastic fragments, without, however, being limited to said recycled cotton fabric and recycled plastic fragments. Consequently and in a non-restrictive embodiment of the present invention, the upper covered in step (a) comprises an upper (14, 14*a*) made of recycled cotton fabric in amounts between 70 and 30% in weight of the upper (14, 14*a*) and recycled plastic fragments in quantities between 30 and 70% in weight of the upper (14). Said upper (14, 14*a*) comprises a foam-based portion (14*a*) of recycled material and a tongue (17). Said tongue (17), in turn, comprises a portion (17*a*) for adding a rubber stamp.

Regarding step (b), the internal linings have as their functional objective the protection of the internal surfaces of the upper and the upper surface of the insole.

In a non-restrictive embodiment of the present invention, the midsole of natural material comprises a midsole (11) of coconut fibers. The recycled midsole, in turn, comprises a midsole (12) of recycled fabric fibers, also known as Strobel. In this context, the insole is a structure comprising four overlapping layers, the upper layer being the lining of the insole (F), the white latex midsole (L) disposed below the insole lining (F), the recycled midsole disposed below the white latex midsole and the natural material midsole disposed below the recycled midsole. In this sense, the presence of the white latex (L) midsole is important for the physical protection of the layers below (recycled midsole and natural material midsole).

The insole upper features in its inner part the exposed insole surface, said exposed insole surface being the upper surface of the insole lining (F) (on which the removable insole is inserted). In this way, the insole upper is positioned "upside down" on a flat support of the shape-regulating device, so that the flat support fits into the upper with upside-down insole, allowing the upper surface of the flat support to be completely overlapped by the insole surface of the insole lining (F). With this positioning of the upper with an insole, an operator adjusts its shape by hammering the surface of the midsole of natural material exposed externally (still exposed before bonding the recycled sole) which, in this situation, is facing upwards.

With respect to the bonding that occurs in steps (e), (g) and (h), the glue is added to the exposed surface of the recycled midsole and on the side walls (10*a*) of the recycled sole (10). The glue present on the surface of the recycled midsole allows the bonding of the natural material midsole just below. The glue present only on the sides of the recycled sole, without extending to its internal surface that will be in contact with the exposed surface of the natural material midsole, allows the surfaces of the recycled sole and the natural material midsole to remain in contact without the presence of glue. This allows for easy recycling of such materials later. The glue is applied three times on the side walls (10*a*) of the recycled sole (10), and applied twice on the surface of the recycled midsole.

Regarding step (j), the covered heating allows the optimization of the adhesion between the recycled sole and the insole upper after the addition of glue.

Still in relation to step (j), the cooling of the semi-finished footwear occurs in a way that the semi-finished footwear goes through a cooling conveyor. In this cooling, the footwear contracts and the glue is activated. In a non-restrictive embodiment of the present invention, the recycled sole comprises a mixed sole (10) comprising virgin rubber in amounts between 60 and 40% in weight of the mixed sole (10) and recycled rubber in amounts between 40 and 60% in weight of the sole (10).

In the case of step (k) and in a non-restrictive embodiment of the present invention, the removable insole comprises a removable insole (13) comprising an upper layer of cork sewn to a lower layer of natural latex. In a non-restrictive embodiment of the present invention, the removable insole (13) additionally comprises an aesthetic layer (C) adhered to its upper surface, said aesthetic layer (C) comprising the illustration of a brand or illustrations according to the preference of a technician carrying out the process described herein, object of the present invention.

In a non-restrictive embodiment of the present invention, the first recycled fabric, the natural material midsole, recycled midsole, the white latex (L) midsole, the recycled sole and the removable insole are components originating from footwear in general, being one of the differentials of the process now described with regard to the reuse of recycled, recyclable and natural components. Alternatively, the first recycled fabric, the natural material midsole, recycled midsole, the white latex (L) midsole, the recycled sole and the removable insole are components from the footwear (1) involved in the process described and described below, being another object of the present invention. The reuse of said components reduces waste resulting from the excessive disposal of footwear by presenting components such as these, or even the components themselves, which may have a different origin than footwear in general. In this sense, in a non-restrictive embodiment of the present invention, the first recycled fabric, the natural material midsole, recycled midsole, the white latex (L) midsole, the recycled sole and the removable insole are components from distinct origin of footwear in general. The reuse of such components also allows a circular economy model, as another differential of the process now described, object of the present invention. In this sense, used shoes can return to the process just described, favoring the production of new shoes by reusing their components.

Still with respect to the process now described, the object of the present invention, it can be performed without the need for water, avoiding waste and excessive use of an indispensable resource for human survival.

This is because in the described process there is no step involving dyeing fabrics, since they already have colors and are separated according to the desired color.

It is important to note that the following description, related to the footwear (1), another object of the present invention, as well as the description of its components, must also be taken into account for the better understanding described here.

In a second aspect, the present invention relates to a FOOTWEAR (1) comprising the following components:

- an internal lining comprising: an insole (11) of coconut fibers glued below an insole (12) of recycled fabric fibers; a white latex midsole (L) sewn over the midsole (12); and an insole lining (F) sewn over the white latex midsole (L);
- an upper (14, 14*a*) comprising the insole sewn on its base, said upper (14, 14*a*) being based on a mixture of recycled cotton fabric with recycled plastic fragments;
- a mixed sole (10) based on virgin rubber and recycled rubber, said mixed sole (10) being glued and sewn on the upper (14, 14*a*), said mixed sole (10) covering the insole
- a removable insole (13) comprising an upper layer of cork sewn to a lower layer of natural latex; and
- metal-free eyelets (15).

With respect to the midsole (11), comprised in the insole, it is a natural material from coconut fiber residues, thus allowing the use and recycling of natural materials, being another differential of the present invention. The use of midsole (11) based on coconut fibers is a sustainable alternative that provides comfort to the user. Most of the state-of-the-art midsoles are made with polyurethane (PU) or EVA, industrialized products that are harmful to the environment and that compromise the health of consumers. Thus, in addition to providing comfort, the use of coconut fibers is a healthy alternative for the planet and its users.

With respect to the midsole (12), also included in the insole, this consists of a layer arranged on the midsole (11). The recycled fabric fibers that make up the midsole (12) and the lining of the insole (F) are also a differential of the present invention, since they are recycled materials, generating reuse and, simultaneously, guaranteeing greater comfort and softness when walking, as well as absorbing the impact of the step. The white latex midsole (L), also included in said insole, in turn, allows the physical protection of the layers below, namely the midsole (12) (immediately below the midsole (L)) and the midsole (11) (immediately below the midsole (12)).

Furthermore, said insole is one of the differentials of the present invention because its structure in four layers, based on said midsole (11), said midsole (12), said midsole (L) and the insole lining (F), absorb the impact of the step more efficiently. The order of these layers, that is, the lower disposition of the midsole (11) of coconut fibers, the immediately superior disposition of the midsole (12) of recycled fabric fibers, the immediately superior disposition of the white latex midsole (L) and the immediately superior arrangement of the insole lining (F), is also a differential of the present invention, since if the midsole (11) of coconut fibers was used on the midsole (12) of recycled fabric fibers, on the midsole of white latex (L) or on the lining of the insole (F), the coconut fibers would break apart more easily with continuous use, causing discomfort during use. The same would occur if the coconut fiber midsole (11) was used instead of the cork layer or the natural latex layer present in the removable insole (13). The arrangement of the coconut fiber midsole (11) below the recycled fabric fiber midsole (12) therefore allows for greater durability of the coconut fibers, extending and maximizing the user's comfort. This durability is also improved due to the presence of the white latex midsole (L) above the midsole (12) and (11), as it guarantees physical protection. Additionally, the order described below maximizes the comfort provided by the footwear (1) to the user, said order being:

- coconut fiber midsole (11) below the recycled fabric fiber midsole (12);
- white latex midsole (L) over midsole (12) made from recycled fabric fibers
- insole lining (F) on the white latex midsole (L);
- the natural latex layer (present in the removable insole (13)), above the lining of the insole (F); and
- the cork layer (present in the removable insole (13)), above the natural latex layer.

In the case of the upper (14, 14*a*), it comprises cotton fabric recycled in quantities between 70 and 30% in weight of the upper (14, 14*a*) and plastic fragments recycled in quantities between 30 and 70% in weight of the upper (14, 14*a*). In the state-of-the-art the shoe upper is usually made of materials such as leather, suede, canvas or nubuck. Most of these options are not sustainable and, in this sense, this invention also presents recycled cotton fabric as a differential. In addition, the upper (14, 14*a*) features a mixture of recycled cotton fabric with recycled plastic fragments, creating a new thread. The presence of plastic fragments in this mixture provides greater mechanical resistance to the upper (14, 14*a*), being one of the differentials of the present invention compared to the state-of-the-art technologies. Also, the presence of plastic fragments in said mixture allows to remove plastic bottles, such as PET bottles, from the environment, giving them a new purpose and making the product even more sustainable. In addition, the upper (14, 14*a*), as well as the rest of the footwear (1) components are free of ink, as the colors observed come from scraps of fabrics from the textile industry, which are separated by color. The elimination of the need for dyeing consequently eliminates the need to use water in the production process of sustainable footwear, also object of the present invention, as will be seen below. In one embodiment of the present invention, recycled plastic fragments consist of recycled plastic fragments from plastic bottles, preferably PET bottles. Said upper (14, 14*a*) further comprises a recycled material foam-based portion (14*a*) and a tongue (17). Said tongue (17), in turn, comprises a portion (17*a*) for adding a rubber stamp.

With respect to the mixed sole (10) present in the footwear (1), object of the present invention, this comprises virgin rubber in quantities between 60 and 40% in weight of the mixed sole (10) and recycled rubber in quantities between 40 and 60% in weight of the mixed sole (10). The presence of recycled rubber in the mixed sole (10) also allows the recycling of rubbers that would be discarded in the environment. State-of-the-art footwear features only non-recycled rubbers on the sole, besides, said rubbers are thermoplastic rubbers. The presence of thermoplastic rubber generates contamination and pollution at various levels, including environmental and health problems for domestic and industrial consumers. In addition to having thermoplastic rubber and derivatives, state-of-the-art technologies also do not comprise recycled rubber proposed in the present invention. This gives footwear (1) a differential in the context of sustainability, preservation of the environment and reuse of raw materials. The upper surface of the mixed sole (10) is immediately in contact with the lower surface of the insole without the presence of glue, which facilitates the future recycling of the mixed sole (10) or the insole. Additionally, when glued and sewn on the upper (14), a mixed sole (10) covers the visible portions of the insole, giving it exclusive aesthetics.

Regarding the removable insole (13), it is insertable inside the upper (14), being positioned just above the lining of the insole (F), said lining of the insole (F) included in the insole already sewn to the upper (14). The removable insole (13) consists of the main footwear (1) insole, being another differential of the present invention in that it provides comfort, promotes sustainability and consumer health due to the presence of the upper layer of cork and the lower layer of natural latex. In addition, the presence of cork in the said removable insole (13) provides antibacterial, anti-odor and anti-moisture properties, and is also a differential compared to state-of-the-art shoes. In a non-restrictive embodiment of the present invention, the removable insole (13) additionally comprises an aesthetic layer (C) adhered to its upper surface, said aesthetic layer (C) comprising the illustration of a brand or illustrations according to the preference of a technician executing the process described herein, object of the present invention.

It is important to mention the objective of providing a removable insole (13) of only two layers, instead of a removable insole of more than 3 layers. The fact that the number of layers in removable insoles is minimized, bringing them to the insole structure, allows greater protection against moisture and is not exposed to wear, increasing the durability and quality of the product. In the state-of-the-art shoes, for example, there are removable insoles containing, simultaneously, layers of coconut, fabric, latex and cork (4 layers), constantly exposing these layers to wear and moisture, impairing the durability of the shoes. In the present invention, the removable insole (13) comprises only two layers.

In a non-restrictive embodiment of the present invention, the footwear (1) additionally comprises a lace (16) made of cotton.

In a non-restrictive embodiment of the present invention, the footwear (1) comprises an internal lining, with a covering and protection function, which covers and protects the internal upper surfaces (14,14*a*). The lining of the insole (F), similarly to the inner lining that covers the upper internally (14,14*a*), also has the function of covering and protecting the insole sewn on the upper (14,14*a*). The inner lining of the upper and the lining of the insole (F) consist of a thin fabric.

The presence of metal-free eyelets (15) facilitates the recycling of footwear (1), as it eliminates a step of separating the metal eyelets from the upper. In addition, after the separation of said metal eyelets, they are sent to casting processes for reuse. Although it is an option for reusing the metals that make up the metal eyelets, the smelting processes generate polluting and toxic gases, negatively impacting the environment. Therefore, metal-free eyelets (15) also provide less environmental impact, meeting the purpose of the present invention.

As described, the footwear (1) is a product in which it is intended to maximize its sustainability features, since it has components of renewable origin that, in addition to being recycled, are also recyclable, and can return numerous times to the production process of footwear, also object of the present invention. This is another differential, as it consists of a Circular Bio Economy model in which the products used by consumers are reused in their original production process. Alternatively, if the consumer only decides to discard the footwear (1), it also features components that are easily recycled and decomposed in the environment, reducing negative environmental impacts.

It is important to reiterate that in addition to making use of natural, recycled and recyclable components, the footwear (1) also presents comfort to the consumer, an unexpected result, since in the sustainable footwear industry the use of natural and recycled products generally decreases the comfort, motivating the business towards the use of virgin raw materials. In this sense, the present invention presents a product that is both comfortable and comprises renewable origin, natural, recycled and recyclable components. In addition, the inappropriate use of natural and recycled products in sustainable footwear also compromises the quality of the product, generating shoes that have structural characteristics that are completely out of compliance. As will be seen in the examples of implementation, the footwear (1) unexpectedly comprises structural characteristics mainly within the conformities required in technical standards of quality standards, better highlighted below.

Due to the use of renewable, natural, recycled and recyclable components, the footwear (1) avoids environmental damage to nature and man, supporting conservation and preservation practices. In this sense, the high water consumption, environmental degradation and pollution are one of the main problems solved by the present invention in relation to the closest state-of-the-art technologies.

EXAMPLES

Tables 1 and 2 below show the structural characteristics of the footwear (1), showing unexpected results mostly in accordance with technical standards and quality standards. As it is a footwear (1) comprising renewable origin, natural, recycled and recyclable components, the state-of-the-art does not present solutions for the results shown below, being one of the differentials of the present invention.

It should be understood that the modalities of the invention described in the examples that follow are intended only to highlight technical features that reflect the invention as a whole, without being limited to the examples herein described.

For the resistance test on the footwear (1), the following materials were used, referring to a sustainable footwear embodiment (1):

- a white/gray footwear (1), left foot, size 35;
- a sample of textile material for cutting, one in white and one in gray; and
- a pair of beige soles, size 35.

The results of the footwear (1) resistance tests are shown in table 1.

TABLE 1

Results of footwear (1) resistance tests according to standard technical standards of quality.

| Test | Standard technical standards of quality | Unit of measurement | Result | Specification | Compliance |
|---|---|---|---|---|---|
| Density (pycnometer) recycled fabric fiber | ISO2781 - Met.B/A1: 2010-2008 | $g/cm^3$ | 1.07; 1.07 (average = 1.07) | x | x |
| Tear resistance - sole | ISO20872 - 2001 | N/mm | 6.1 | minimum 8.0 | Not compliant |
| Seams resistance - cut/cut; sneakers tongue | ISO17697-met.B-2016 | N/mm | >19 | minimum 10 | Compliant |
| Seams resistance - sole/cut; internal flexion | ISO17697-met.B-2016 | N/mm | 3.8 - thread failure | minimum 10 | Not compliant |
| Seams resistance - sole/cut; internal flexion | ISO17697-met.B-2016 | N/mm | 4.3 - thread failure | minimum 10 | Compliant |
| Tear resistance - white textile material - medium strength (X + Y direction) | EN ISO17696 - 2004 | N | 124 + 66 | minimum 40 | Compliant |
| Tear resistance - gray textile material - medium strength | EN ISO17696 - 2004 | N | 32 | minimum 40 | Not compliant |
| Benwart flexural strength - 30,000 textile material flexions | ISO17707-2005 | Mm | 0.1 - without slits | Maximum 5.0/ without slits | Compliant |
| Abrasion resistance - back of footwear area | ISO20871-2001 | $mm^3$ | 199 | maximum 250 | Compliant |
| Abrasion resistance: lace and orifice - 10,000 cycles | EN ISO22774-Met.3-2004 | X | break at 2738 cycles | without break | Not compliant |

TABLE 1-continued

Results of footwear (1) resistance tests according to standard technical standards of quality.

| Test | Standard technical standards of quality | Unit of measurement | Result | Specification | Compliance |
|---|---|---|---|---|---|
| Martindale abrasion resistance: dry - 12,800 cycles | EN ISO17704-2004 | x | very light wear | at most, moderate wear | Compliant |
| Outside part of upper Martindale abrasion resistance: wet - 6,400 cycles | EN ISO17704-2004 | x | very light wear | at most, moderate wear | Compliant |
| Outside part of upper Pulling force of the textile strip - heel/heel area | CTCP1-44-2013 | N | 232 - tearing; cut | minimum 250 | Not compliant |
| Flexural strength - Bally method: dry - 80k cycles (X + Y direction) Upper | EN ISO17694-2016 | x | no visible damage | no visible damage | Compliant |

According to table 1, most of the results of footwear (1) resistance are in accordance with the standard technical quality standards of Portugal (referenced in table 1), showing unexpected results that reflect one of the differentials of the present invention and its quality standard in relation to state-of-the-art technologies.

Resistance tests were also carried out on a type of removable insole (13), being a pair of cork-based and natural latex removable insoles (13), size 23.

The results of the resistance tests of said pair of removable insoles (13) are shown in table 2.

TABLE 2

Results of the resistance tests of the pair of removable insoles (13) according to standard technical standards of quality.

| Test | Standard technical standards of quality | Unit of measurement | Result | Specification | Compliance |
|---|---|---|---|---|---|
| Wear over time - 7 days/70° C./ 100% high resilience (HR) | ISO20870-2017 | visual analysis | no change in appearance | x | x |
| Wear over time - 7 days/70° C. | ISO20870-2017 | visual analysis | no change in appearance | x | X |
| Cork/natural latex adhesion strength: initial - inside + outside | CTCP1-56-2017 | N/mm | 0.19 + 0.11 | minimum 0.5 | Not compliant |
| Cork/natural latex adhesion strength: after 7 days, 70° C., 100% | CTCP1-56-2017 | N/mm | 0.12 | x | x |

TABLE 2-continued

| Results of the resistance tests of the pair of removable insoles (13) according to standard technical standards of quality. | | | | | |
|---|---|---|---|---|---|
| Test | Standard technical standards of quality | Unit of measurement | Result | Specification | Compliance |
| high resilience (HR) - outside Cork/natural latex adhesion strength: after 7 days, 70° C., 100% high resilience (HR) - inside | CTCP1-56-2017 | N/mm | 0.18 | x | x |

According to table 2, most of the resistance results of the pair of removable insoles (13) are in accordance with the standard technical standards of quality of Portugal (referenced in table 2), also showing unexpected results that reflect one of the differentials of the present invention and its quality standard compared to the state-of-the-art technologies.

It should be understood that the present description does not limit the application to the details described herein and that the invention is capable of other modalities and being practiced or performed in a variety of ways, within the scope of the claims. Although specific terms have been used, these terms should be interpreted in a generic and descriptive sense, and not with a limiting purpose.

What is claimed is:

1. A footwear production process, comprising the following steps:

(a) cutting a first fabric, thereby obtaining an insole lining;

(b) cutting a first recycled fabric, thereby obtaining an upper, said upper comprising metal-free eyelets;

(c) positioning the insole lining on a white latex midsole;

(d) positioning the white latex midsole on a recycled midsole;

(e) simultaneously sewing the insole lining, the white latex midsole, and the recycled midsole to the upper, so that a surface of the recycled midsole is exposed;

(f) bonding a natural material midsole to the exposed surface of the recycled midsole, thereby creating an insole upper, the insole upper comprising, in layered arrangement, the upper, the insole lining, the white latex midsole, the recycled midsole and the natural material midsole, in that order, and so that a surface of the natural material midsole is exposed;

(g) positioning the insole upper in a format-regulating device;

(h) adding glue to side walls of a recycled sole;

(i) bonding the side walls of the recycled sole to lower sides of the insole upper, thereby obtaining a semi-finished footwear;

(j) drying the semi-finished footwear for a period of time between 1 and 8 minutes, under a temperature between 25 and 60° C.;

(k) cooling the semi-finished footwear to room temperature; and (l) adding a removable insole inside the semi-finished footwear and adding laces to the metal-free eyelets present in an upper half of the semi-finished footwear, thereby completing the footwear.

2. The process according to claim 1, wherein the upper is made of recycled cotton fabric in quantities between 30 and 70% by weight of the upper and recycled plastic fragments in quantities between 30 and 70% by weight of the upper, wherein the upper further comprising a foam-based portion of recycled material and a tongue, the tongue comprising a portion for adding a rubber stamp, wherein the natural material midsole comprises coconut fibers, wherein the recycled midsole comprises recycled fabric fibers, wherein the recycled sole comprises virgin rubber in amounts between 40 and 60% by weight of the sole and recycled rubber in amounts between 40 and 60% by weight of the sole, and wherein the removable insole comprises an upper layer of cork sewn to a lower layer of natural latex, the removable insole additionally comprising an aesthetic layer adhered to an upper surface of the removable insole.

3. The process according to claim 1, wherein the first recycled fabric, the natural material midsole, the recycled midsole, the white latex midsole, the recycled sole and the removable insole are components utilized from preexisting footwear.

4. The process according to claim 1, wherein the first recycled fabric, the natural material midsole, the recycled midsole, the white latex midsole, the recycled sole and the removable insole are components utilized from preexisting non-footwear.

* * * * *